US005616192A

United States Patent [19]

Nakagawa

[11] Patent Number: 5,616,192

[45] Date of Patent: Apr. 1, 1997

[54] COIL RETAINER FOR ENGINE VALVE AND PREPARATION OF THE SAME

[75] Inventor: Seiichi Nakagawa, Fujisawa, Japan

[73] Assignee: Fuji Oozx Inc., Kanagawa-ken, Japan

[21] Appl. No.: 579,904

[22] Filed: Dec. 28, 1995

Related U.S. Application Data

[63] Continuation-in-part of Ser. No. 358,417, Dec. 19, 1994, abandoned.

[30] Foreign Application Priority Data

Jul. 21, 1994 [JP] Japan ..... 6-169813

[51] Int. Cl.[6] ..... F01L 3/10; C22F 1/04

[52] U.S. Cl. ..... 148/690; 148/697; 148/700; 148/439; 420/534

[58] Field of Search ..... 148/690, 697, 148/700, 439; 420/534

[56] References Cited

U.S. PATENT DOCUMENTS 4,786,340 11/1988 Ogawa et al. ..... 148/439

FOREIGN PATENT DOCUMENTS 56-93849 7/1981 Japan .
1-39339 2/1989 Japan .
1-56844 3/1989 Japan .
3-6344 1/1991 Japan .
3-10060 4/1991 Japan .
3-219089 9/1991 Japan .
4-214846 8/1992 Japan .
4-341537 11/1992 Japan .
5-5107 1/1993 Japan .
5-295515 11/1993 Japan .
6-10627 1/1994 Japan .
6-74008 3/1994 Japan .
2130941 6/1984 United Kingdom .

*Primary Examiner*—Sikyin Ip
*Attorney, Agent, or Firm*—Hoffman, Wasson & Gitler, PC

[57] ABSTRACT

There is provided a coil retainer for an engine valve to be mounted therewithin, said retainer prepared by forging of an aluminum-based alloy of the following composition; followed by special combined heat treatments to convert into an alloy material having a dendrite arm spacing value less than 15 micrometer; and the composition being composed of Silicon: 8 to 17 weight percent;

Copper: 2 to 5 weight percent;

Magnesium: 0.2 to 10 weight percent;

Manganese: 0.1 to 1.5 weight percent;

the balance of the composition being aluminum and inevitable amount of impurities.

4 Claims, 3 Drawing Sheets

PRIOR ART

COIL RETAINER FOR ENGINE VALVE AND PREPARATION OF THE SAME

This application is a continuation-in-part of applications(s) Ser. No. 08/358,417 filed on Dec. 19, 1994, now abandoned.

FIELD OF THE INVENTION

The present invention relates to a coil retainer in use for an engine valve, and further a process of manufacturing the coil retainer. The coil retainer has a specific composition of aluminum based alloy, and can be manufactured only by the specific process comprising special treatments.

DESCRIPTION OF THE PRIOR ART

A conventionally used coil retainer in use for an internal engine valve is as shown in FIG. 1 (prior art). Referring to FIG. 1, there is shown a partial view in partial section of an internal engine valve 1 of which the end is mounted through a pair of cotters 3, 3 on a coil retainer 2, on which a spring coil 4 is stemmed within a hollow of the valve 1 against a cylinder head (not shown).

The valve 1 is driven by movement of a cam 7 pressing the upper surface of a shim 6 embedded in a tappet 5 of the valve 1. Such engine provided with a direct movement type valve has smaller numbers of members therefor, and therefore the allowable number of revolution of the engine can be improved so as to raise a power performance of the engine.

One of the obstacles for the allowable number of revolution of the engine to raise is a weight of a moving valve assembly. When the weight of the valve assembly increases, the inertial mass of the valve will be increased so as to lose a follow-up character to the movement of the cam, thereby affecting efficiency of suction and exhaust valve to lower the power of the engine. Recently, there has been used an aluminum alloy in place of iron, for a retainer 2 to be mounted on a tappet 5 and a valve spring coil 4, thereby reducing the inertial mass of the valve assembly.

However, the retainer 2 must be exposed to repetition of high weight loading at the contact portion with the end of the coil 4, and therefore, the retainer made of the aluminum based alloy which has less abrasion resistance than that of iron will be more abraded at the contact portion 2 with the coil 4, to cause some trouble on durability of the engine.

There have been proposed the use of an aluminum alloy for a light-weighted retainer in Japanese (Unexamined) Patent Laid-open application No. 2-147804/1990, and the use of a titanium alloy in Japanese (Unexamined) Patent Laid-open application No. 4-171206/1992, and the use of other light metal alloy for a retainer. However, there has been found several disadvantages such as lack of abrasion durability and lack of permanent set in fatigue.

In order to overcome such disadvantages, the prior art aluminum alloy retainer uses a metal lining embeded in the contact portion with the coil (e.g. Japanese (Unexamined) Patent Laid-open application No. 63-50613/1988, Japanese (Unexamined) Utility Model Laid-open application No. 63-34312/1988), and further, there is proposed use of a fiber reinforced aluminum alloy with a plated coating layer on the surface thereof (Japanese (Unexamined) Patent Laid-open application No. 62-45915/1987; to improve the abrasion resistance of the contact portion with the coil, and further alumitization (making alumite surface layer) of surface layer, i.e. surface treatment of the aluminum alloy to improve abrasion resistance, and dispersion of hard material such as ceramic powder in the aluminum alloy to impart abrasion proof. Such improvement or rearrangement of the surface of the alloy will raise the cost of manufacture of the retainer.

GB 2130941 teaches the features of an aluminum wrought cast product having dendrite arm spacing (DAS) less than 20 μm. The disclosed cast aluminum base alloy bar for forgings, comprises 4.0 to 12.0 wt % of silicon, 0.6 to 1.3 wt % of magnesium.

Japanese Patent Laid-open (unexamined) application 64-39339/1987 discloses a wear-resistant Al alloy for automotive rods containing Si: 7.5–22.0%, Cu: 3.0–7.0%, Mg: 0.3–1.0%, Fe: 0.25–1.0%, Mn: 0.25–1.0%, Sr: 0.005–0.1% and balancing Al, in which the dendrite arm spacing is restricted to less than 10 μm. The Al alloy rods are cast at 670–554° C., and cooled in a rate of more than about 5° C. from 670° C. to 554° C. and in a rate of more than 10° C. from 560° C. to 554° C., and then heat-treated at 450–510° C. for 2 to 12 hours, so as to have the DAS of less than 10 μm.

Japanese Patent Laid-open (unexamined) application 56-93849/1979 discloses an aluminum based alloy in use for bearing, which comprises Si: 5.0–8.0%, Cu: 1.5–3.5%, Sn: 1.0–5.5%, and optionally one or more elements selected from Mn: 0.2–1.5%, Mg: 0.5–1.5%, Ta: 0.01–0.2%, B: 0.002–0.04% with provision that Ti+B is 0.2% or less, and balancing Al and inevitable impurities. The structure of the aluminum based alloy has grain sizes of 200 microns or less, and a secondary dendrite arm space of 40 μm or less, and intermetallic phase grains of 30 microns or less. The alloy is useful as bearing material for oil pressure pump.

U.S. Pat. No. 4,786,340 teaches a solution heat-treated high strength aluminum based alloy consisting essentially of 5 to 13 wt % silicon, 1 to 5 wt % copper, 0.1 to 0.5 wt % magnesium, 0.005 to 0.3 wt %, strontium, and the balancing aluminum.

SUMMARY OF THE INVENTION

It is an object of the present invention to provide a coil retainer for an engine valve with highly competitive performance at a substantial cost saving.

It is other object of the present invention to provide an aluminum based alloy with highly competitive performance without need of additional reinforcing fibers to be incorporated.

It is another object of the present invention to provide an aluminum based alloy with light weight as well as high abrasion durability.

It is other object of the present invention to provide an aluminum based alloy composition without need of additional plating step, which comprises only relatively uncostly ingredients.

The further object of the present invention will be understood from the below description.

A more detailed description of the invention is facilitated by reference to the drawings which form a part of this specification and wherein:

DETAILED DESCRIPTION OF PREFERRED EMBODIMENTS

Figure 1:
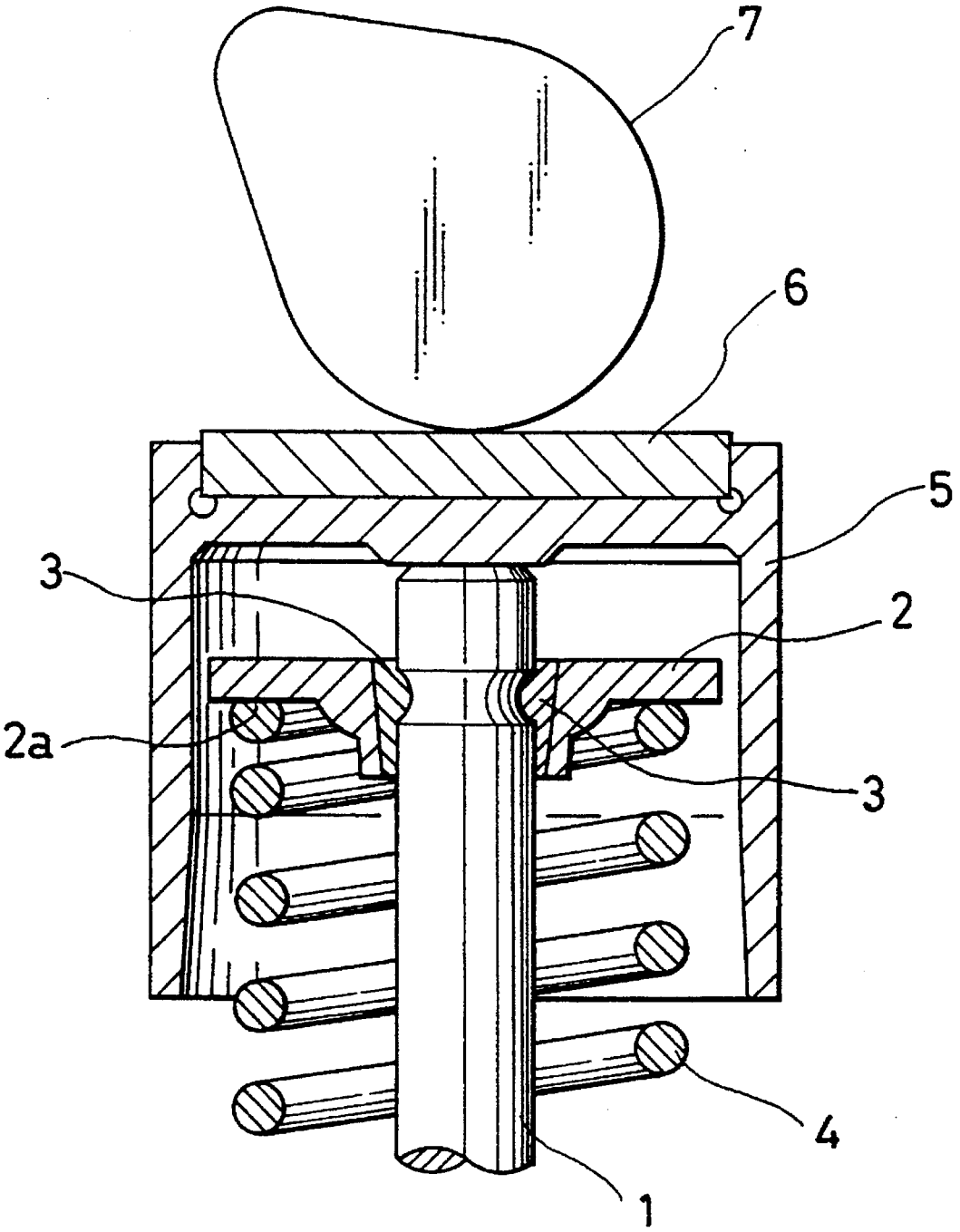
FIG. 1 is a fragmentary elevational view in partial section, of a coil retainer and engine valve and a spring coil mounted on the engine valve

The prior art retainer needs a different metal member such as a surface hard layer, and an additional step of binding such metal member to the retainer, to increase a manufacturing cost. Further, the weight of the retainer will raise because of the different metal member.

In accordance with the present invention, a coil retainer for an engine valve to be mounted thereon can be manufactured from an aluminum based alloy composition consisting essentially of Silicon: 8 to 17 weight percent;

Copper: 2 to 5 weight percent;

Magnesium: 0.2 to 10 weight percent;

Manganese: 0.1 to 1.5 weight percent;

balancing aluminium and inevitable amount of impurities, only by forging the above aluminum based alloy; followed by special heat treatment to convert it into an alloy material having a dendrite arm spacing value less than 15 micrometer.

Such aluminum based alloy has not been known. An aluminum base alloy of JIS standard No. 4032 comprises 11 to 13.5 weight percent of silicon, 0.50 to 1.5 weight percent of copper, 0.8 to 1.3 weight percent of magnesium, 0 weight percent of manganese. An aluminum alloy moulding and die casting respectively of JIS standard No. AC 8B and AC 8C comprise 8.5 to 10.5 weight percent of silicon, 1.0 weight percent of iron, 2.0 to 4.0 weight percent of copper, 0.50 weight percent of manganese, 0.50 to 1.5 weight percent of magnesium, 0.50 weight percent of zinc.

What is critically important is that the aluminum based alloy for the coil retainer formed for an engine valve spring coil thereon contain the following ingredients in the proportion below:

Silicon: 8 to 17 weight percent;

Copper: 2 to 5 weight percent;

Magnesium: 0.2 to 10 weight percent;

Manganese: 0.1 to 1.5 weight percent; balancing aluminium and inevitable amount of impurities.

The dendrite arm spacing value of the aluminum based alloy should be less than 15 micrometer.

The blank of the retainer having the above aluminum based alloy composition is forged especially at a cold temperature.

Therefore, the retainer of the present invention has significant economy, because of saving cost of starting material (not use of costly metals), and of saving steps (without need of additional steps).

The reasons for the limitation of each ingredient in the aluminum based alloy composition in use for the preparation of the coil retainer are as follows:

Silicon is added so as to ensure hardness and abrasion resistance of the prepared retainer at the desired levels.

The content of silicon ranges from 8% by weight to 17% by weight. The hardness and the abrasion resistance cannot be afforded enough to be used as a coil retainer, when the content of silicone is less than 8% by weight. Further, when the content of silicon exceed 17% by weight, the workability ( work limit of the material) is dramatically reduced, and thereby, the strength and fatigue limit are significantly decreased.

The content of copper ranges from 2 to 5% by weight. When the content of copper is up to 2% by weight, the strength of the retainer cannot be afforded at the desired sufficient level. Further, when the content of copper exceeds 5% by weight, the strength of the aluminum alloy will drop.

The content of magnesium ranges from 0.2 to 10 % by weight. When the content of magnesium is higher than 0.2% by weight, the initiation of Si crystallization is restrained to improve the strength, but when the content of magnesium exceeds 10% by weight, the workability of the aluminum alloy will be lowered.

The content of manganese is 0.1 to 1.5% by weight. Within such range, manganese can be effective to maintain the tensile strength high even at high temperature.

Preferably, the DAS (dendrite arm spacing) value of the aluminum alloy should be less than 15 micrometer. When the DAS value exceeds 15 micrometer, the forging workability will drastically drop until it is difficult to forge into a desired shape.

The aluminum based alloy is used to forge into the retainer blank, and then, the blank is exerted to the following specific thermal treatment to impart practical performance of a retainer for an engine valve.

Thermal treatment.

The retainer blank as forged is heated at the temperature ranging 450° to 540° C. to melt partially, and then maintained at the temperature of 150° to 200° C. for one to six hours for aging.

Further, the blank is heated to melt partially, thereby homogenizing the structure of the aluminum alloy. This heating temperature should be 150° to 540° C. When the temperature is up to 450° C., the heating to melt partially is not sufficient, and when the temperature is above 540° C., the blank is excessively heated. The partially melting means melting partially, especially at the margin or the boundary or the inner surface of the grains in the aluminum based alloy being used as a blank for the coil retainer.

The treated blank is further heated at a certain temperature for aging treatment. The optical condition for this aging is at the temperature of 150° to 200° C., and for the period of 1 to 6 hours.

When the aging temperature is up to 150° C., the necessary period will be longer. When the aging temperature is above 200° C., the aging will be excessive. Further, the aging temperature is more preferably 170° to 190° C.

The aging period depending on the aging temperature is preferably 1 to 6 hours. When the aging period is up to 1 hour, the aging is not enough. When the aging period exceeds 6 hours, the aging will be excessive.

The retainer blank after forged and treated at high temperature and aged is finished into a desired shape. The retainer is worked by tumbling, and further treated to impart rust prevention.

When the DAS value of the aluminum alloy blank is above 15 micrometer, the forging limit workability will be significantly decreased to lower the forging workability of the blank. The DAS value of the aluminum alloy is preferably less than 15 micrometer.

When the content of silicon increases, the ratio of the area of an eutectic phase to the whole area will increase, thereby decreasing a forging workability to reduce the workability limit.

The present invention is further illustrated by the following example to show the coil retainer of the present invention, but should not be interpreted for the limitation of the invention.

EXAMPLE I

Retainer Preparation.

Retainer blanks formed from the following aluminum based alloy compositions, and measuring 30 mm in outer diameter were prepared by a cold forging method.

The prepared retainer blanks were heated at the temperature of 490° C., and maintained at the temperature of 180° C. for two hours for aging treatment. The treated retainers were used in an internal engine for testing, and the results are shown in Table 1. The specimen nos. 1 to 3 shown in the table use the composition of the present invention, and the other specimen nos. 4 to 5 are not within the composition specified by the present invention.

TABLE 1

| specimen | Composition (% by weight) | | | | | abrasion of contact face | abrasion of contact end |
|---|---|---|---|---|---|---|---|
| No. | Si | Cu | Mg | Mn | Al | 1* | 2* |
| 1 | 0.17 | 2.3 | 1.5 | — | balance | 0.44 mm | 0.02 mm |
| 2 | 0.11 | 1.5 | 2.4 | 0.07 | balance | 0.34 mm | 0 mm |
| 3 | 7.6 | 2.6 | 0.58 | 0.02 | balance | 0.03 mm | 0.03 mm |
| 4 | 11.7 | 4.30 | 0.60 | 0.25 | balance | 0.01 mm | 0.04 mm |
| 5 | 14.8 | 4.16 | 0.57 | 0.01 | balance | 0.01 mm | 0.03 mm |
| 6 | 17.0 | 4.46 | 0.56 | 0.01 | balance | 0 mm | 0 mm |

1*indicates an abrasion thickness of contact face in the flange of the retainer with a spring coil after 50 hours operation.
2*indicates an abrasion thickness of contact end of the retainer with a spring coil after 50 hours operation.

The table 1 shows the following:

The increase of the silicon content will reduce the abrasion, while the other contents will effect somehow.

When the silicon content is higher than 8% by weight, the abrasion will be reduced to one tenth. Further, the other specific data was measured if necessary for a coil retainer.

Figure 2:
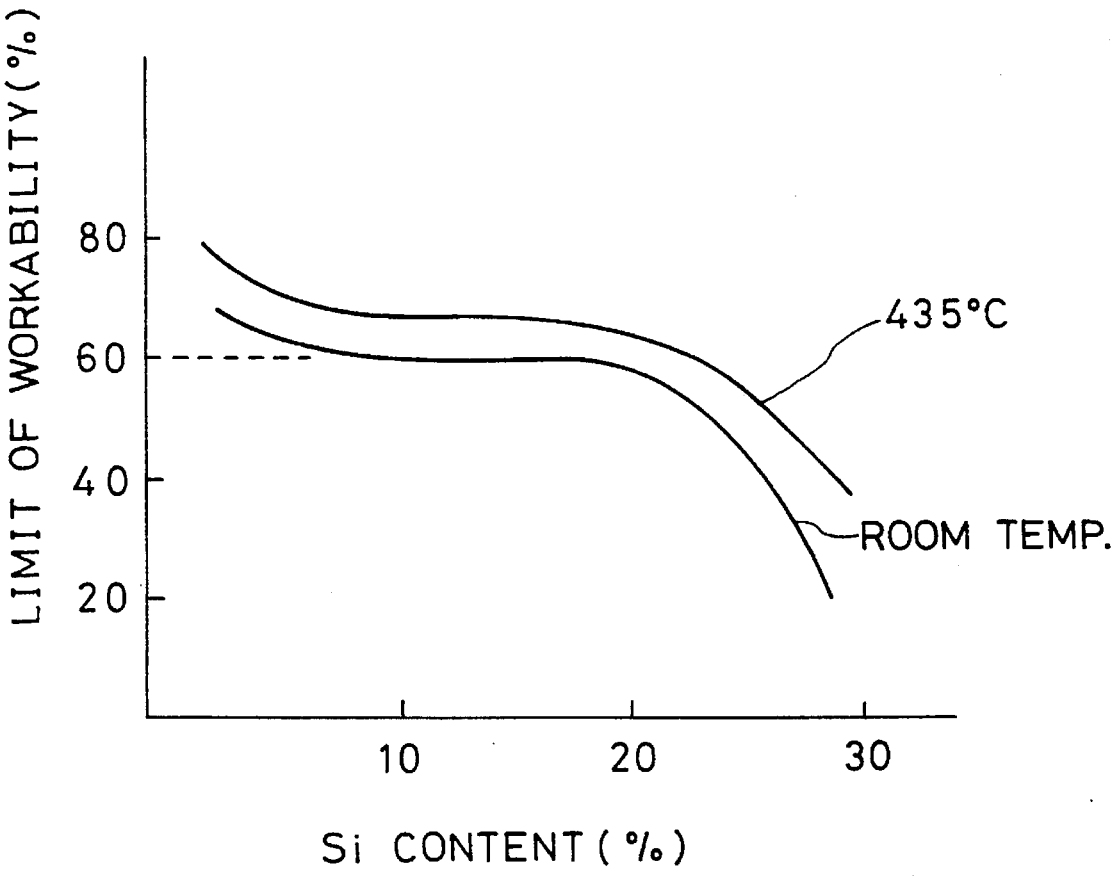
FIG. 2 is a graph showing a relationship between Si content and working limit of pressing or forging of the aluminum based alloy composition being used as a coil retainer.

When the contents of silicone is changed, the workability limit (%) will change as shown in FIG. 2. The workability limit will keep constant when the silicon content changes from 8 weight to 17 weight %, but the work rate limit will decrease drastically when the silicone content becomes more than 17 weight

EXAMPLE II

Tensile Strength at High Temperature

The alloy having the composition of 11.5 wt % of silicon, 4.2 wt % of copper, 0.5 wt % of magnesium, and balancing aluminum is prepared. 0.25 Weight % of manganese is added to the prepared alloy.

The prepared two species: of the alloy (0.25% manganese and Mg free) are heated at the temperature of 490° C., and maintained at the temperature of 230° C. for 30 minutes for aging treatment. The treated alloy pieces are tested for measuring tensile strength at the high testing temperature.

Figure 3:
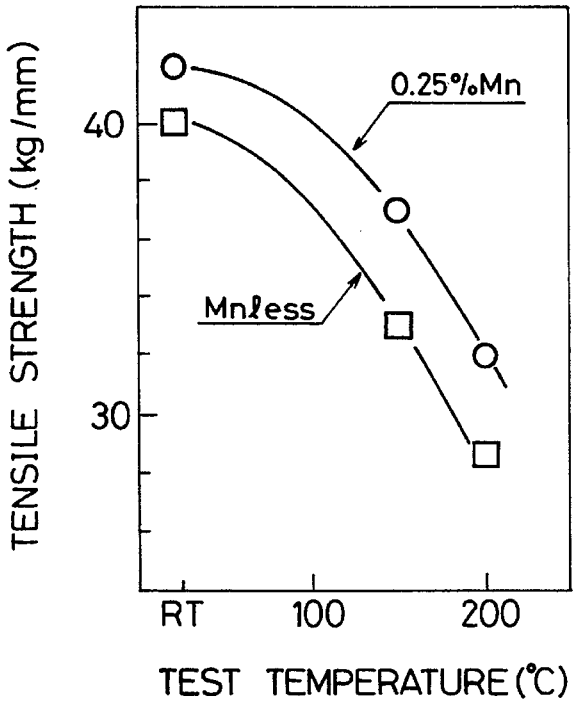
FIG. 3 is a graph showing a relationship between Mn content and Tensile strength of the pressed or forged aluminum based alloy composition being used as a coil retainer.

The result is shown in FIG. 3 of graph in which measured tensile strength is plotted on an ordinate against the testing temperature on abscissa. While squares indicate the results of Mn free alloy, circles indicate those of 0.25% manganese alloy.

Abrasion Resistance and Hardness

The alloy having the composition of 11.5 wt % of silicon, 4.2 wt % of copper, 0.5 wt % of magnesium, and balancing aluminum is prepared. Each of 0.1, 0.25 and 0.4 weight % of manganese is respectively added to the prepared alloy.

Figure 4:
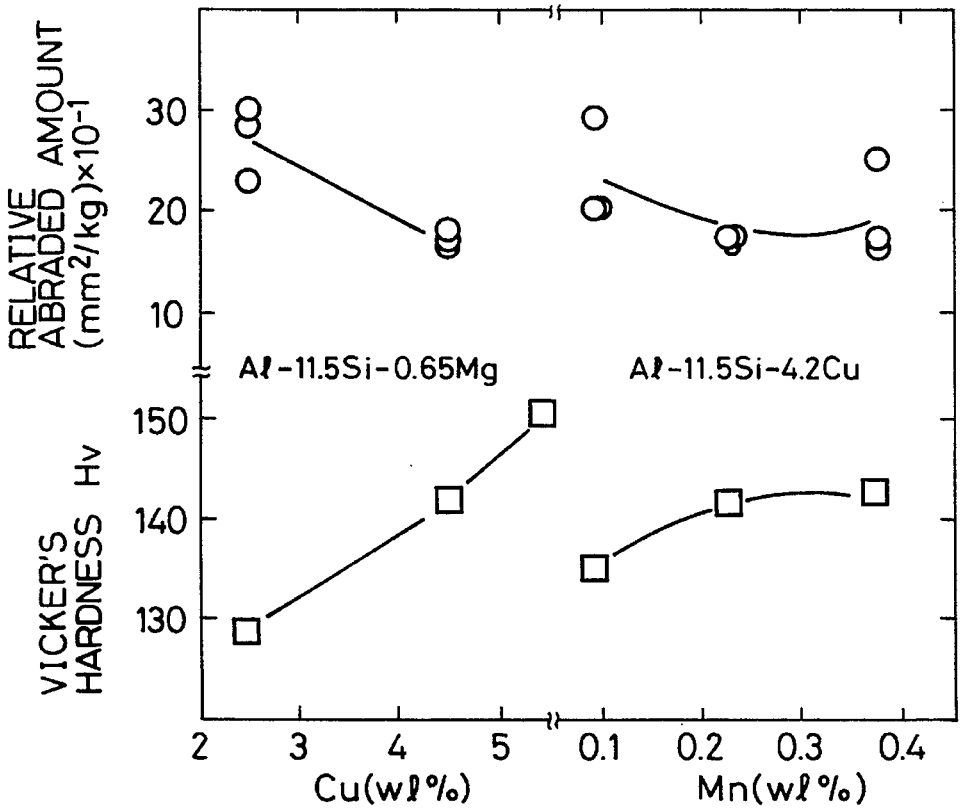
FIG. 4 is a graph showing a relationship between Cu, Mn contents and Abrasion resistance of the pressed or forged aluminum based alloy composition being used as a coil retainer.

Abrasion amount is measured by using a abrasion test of Ookoshi type, in abrading with the material of FC25 in a speed of 11 m/second in the unit of $mm^2/kg\times10^{-1}$. Hardness in Vicker's is measured with change of Mn contents. The results are shown in FIG. 4.

A coil retainer can be manufactured in accordance with the present invention, as follows: An aluminum based alloy bar of the above mentioned composition is cut into a blank of a coil retainer and the blank is worked together with a lubricating agent coated at a cold temperature, and treated at high temperature as the above.

After the blank of the retainer is treated at high temperature to cause partial melting, the retainer is maintained at high temperature for aging. Then, it is finished by tumbling, and is treated to have rust preventive control.

Accordingly, the coil retainer of the present invention, having a specific composition of aluminum based alloy can reduce a cost of manufacture as well as light weight of the product.

Further, the inventive coil retainer does not need any additional metal layer, neither any plating layer, and improve abrasion durability.

It is clear from these test results that the coil retainer of the present invention is quite competitive in terms of wear and abrasion resistance, under the test conditions described, to the substantially more expensive structure of the prior art.

I claim:

1. Coil retainer for an engine valve to be mounted therewithin, said retainer prepared by forging of an aluminum-based alloy of the following composition; followed by special combined heat treatments of solution heat treatment and artificial aging to convert into an alloy material having a dendrite arm spacing value less than 15 micrometer; and the composition consisting essentially of Silicon: 8 to 17 weight percent;

Copper: 2 to 5 weight percent;

Magnesium: 0.2 to 10 weight percent;

Manganese: 0.1 to 1.5 weight percent;

balancing aluminium and inevitable amount of impurities.

2. The coil retainer defined in claim 1, wherein the retainer is forged at higher temperature for the solution heat treatment to melt partially and quenched and then treated for the artificial aging at lower temperature, as the special combined heat treatments.

3. A coil retainer for an engine valve to be mounted therewithin, said retainer prepared by forging of an aluminum-based alloy of the following composition; followed by special combined heat treatments of solution heat treatment and artificial aging, to convert into an alloy material having a dendrite arm spacing value less than 15 micrometer;

wherein the solution heat treatment is carried out at the temperature of 450° to 540° C. to melt partially and especially at the boundary of the grains in the alloy crystals, and then in the next step, maintaining the temperature at 150° to 200° C., for 30 minutes to six hours for the artificial aging, and further finish-working;

the composition consisting of

Silicon: 8 to 17 weight percent;

Copper: 2 to 5 weight percent;

Magnesium: 0.2 to 10 weight percent;

Manganese: 0.1 to 1.5 weight percent;

balancing aluminium and inevitable amount of impurities.

4. A process of manufacturing of a coil retainer for an engine valve to be mounted thereon which comprises the steps of;

forging of an aluminum-based alloy of the following composition;

followed by the following special combined heat treatments to convert into an alloy material having a dendrite arm spacing value less than 15 micrometer;

heating the temperature of 450° to 540° C. to melt partially and at the boundary of the grains in the alloy crystals, and then, maintaining the temperature at 150° to 200° C., for 30 minutes to six hours for aging, and further finish-working;

the composition consisting of

Silicon: 8 to 17 weight percent;

Copper: 2 to 5 weight percent;

Magnesium: 0.2 to 10 weight percent;

Manganese: 0.1 to 1.5 weight percent;

balancing aluminium and inevitable amount of impurities.

* * * * *